US005467909A

United States Patent [19]

Resca et al.

[11] Patent Number: 5,467,909

[45] Date of Patent: Nov. 21, 1995

[54] FIREARM HOLDING DEVICE

[76] Inventors: Franco Resca, 5 Wallace Street, Kilnerpark, Pretoria; Enrico Cupido, 868 Honoria Street, Garsfontein, Pretoria both of South Africa

[21] Appl. No.: 255,759

[22] Filed: Jun. 7, 1994

[30] Foreign Application Priority Data

Jun. 8, 1993 [ZA] South Africa ..... 93/4035

[51] Int. Cl.[6] ..... F41C 33/02

[52] U.S. Cl. ..... 224/244; 224/193; 224/198; 224/243; 224/912

[58] Field of Search ..... 224/192, 193, 224/197, 198, 242, 243, 244, 246, 255, 911, 912

[56] References Cited

U.S. PATENT DOCUMENTS

| | | | |
|---|---|---|---|
| 1,046,912 | 12/1912 | Wanee | 224/243 |
| 1,421,578 | 7/1922 | Schossler | 224/243 |
| 2,109,734 | 3/1938 | Praneta | 224/244 |
| 2,765,107 | 10/1956 | Browning | 224/255 |
| 3,664,560 | 5/1972 | Tolliver | 224/1 R |
| 3,718,240 | 2/1973 | Rose | 224/243 |
| 3,828,990 | 8/1974 | Baldocchi | 224/243 |
| 3,866,276 | 2/1975 | Perkins | 224/259 A |
| 3,910,469 | 10/1975 | Baldocchi | 224/244 |
| 3,915,361 | 10/1975 | Perkins | 224/2 B |
| 3,955,724 | 5/1976 | Perkins | 224/2 B |
| 4,143,798 | 3/1979 | Perkins | 224/243 |
| 4,262,832 | 4/1981 | Perkins | 224/206 |
| 4,273,276 | 6/1981 | Perkins | 224/243 |
| 4,277,007 | 7/1981 | Bianchi et al. | 224/911 |
| 4,424,924 | 1/1984 | Perkins | 224/252 |
| 4,694,980 | 9/1987 | Rogers | 224/243 |
| 4,925,075 | 5/1990 | Rogers | 224/244 |
| 4,934,574 | 6/1990 | Salandre | 224/244 |
| 5,018,654 | 5/1991 | Rogers et al. | 224/244 |
| 5,048,735 | 9/1991 | McCormick | 224/244 |
| 5,100,036 | 3/1992 | Rogers et al. | 224/244 |
| 5,167,355 | 12/1992 | Hill | 224/243 |
| 5,174,482 | 12/1992 | Rogers et al. | 224/239 |
| 5,275,317 | 1/1994 | Rogers | 224/244 |
| 5,372,288 | 12/1994 | Rogers et al. | 224/198 |

FOREIGN PATENT DOCUMENTS

93/0266 1/1993 South Africa .

*Primary Examiner*—Henry J. Recla
*Assistant Examiner*—Charles R. Eloshway
*Attorney, Agent, or Firm*—Roper & Quigg

[57] ABSTRACT

Reference numeral 10 generally indicates a firearm holding device. The holster 10 includes a principal support member 11 which comprises an elongate bar-like body 12 having an upper end 14 and a lower end 16. The upper end 14 defines a receiving formation 18 defined by laterally spaced side-walls 18.1 and 18.2, an end wall 18.3 and a bottom wall 18.4 for releasably receiving a portion of a trigger guard 20 of a handgun 22. A resiliently deformable pawl 42 comprising a resiliently deformable lever 43 having a catch 44 at one end is provided in a recess 46 in the outer side 26 of the broader upper end 14 of the body 12. In the normal rest condition of the pawl 42 the catch 44 projects into the cavity 18. As the trigger guard 20 is pushed downwardly it engages with the catch 44 and displaces the pawl 42 outwardly to its tensed condition. After the trigger guard 20 has slid over the catch 44, the pawl 42 snaps back into position thereby retaining the handgun 22 in position in the holster 10. Withdrawal of the handgun 22 from the holster 10 causes the trigger guard 20 again to slide over the catch 44 and to displace the pawl 42 outwardly to its tensed condition in which the catch 44 is withdrawn from the channel 18, so that the handgun 22 is released when it is withdrawn from the holster 10.

15 Claims, 5 Drawing Sheets

FIREARM HOLDING DEVICE

This invention relates to a firearm holding device.

According to the invention there is provided a firearm holding device which includes a principal support member comprising an elongate body having two ends and provided with a receiving formation at one end thereof for releasably receiving at least a portion of a trigger guard of the firearm, the body leaving the remainder of the firearm exposed;

automatically releasing retaining means on the principal support member, the retaining means operating to retain the firearm in the device when the firearm is positioned in the device, and automatically to release the firearm when it is withdrawn from the device;

a secondary support member spaced from the receiving formation, for supporting a portion of the firearm which is spaced forwardly of the trigger guard when the firearm is positioned in the device; and connecting means secured to the principal support member, for connecting the principal support member to support means for the device.

In this specification, the term "automatically releasing" is to be understood to mean that the retaining means is self-acting when releasing the firearm from the holster.

The secondary support member may be secured to the elongate body, and the location of the secondary support member on the elongate body may be adjustable along the length of the elongate body, such that the device is adjustable to hold firearms of different lengths. For example, the secondary support member may be telescopically extendable or retractable to accommodate various different lengths of barrel, slide or compensating devices in the firearm holding device, more particularly when it takes the form of a holster for a handgun.

The secondary support member may be a support bracket securable at graduated locations along the length of the body, and on which the muzzle end of the firearm is supported in use. The support bracket may include a socket or recess into which the muzzle end of the firearm fits. Instead, the support bracket may include a spigot, e.g. a cone-shaped or rod-shaped member, which is receivable in the muzzle of the firearm.

The principal support member may include guide means for guiding a portion of the firearm forward of the trigger guard into the secondary support member when the firearm is inserted into the holding device. The guide means may be a groove or channel formation in the elongate body. The guide means may be integrally formed with the elongate body. The guide means may, instead, be removable.

The receiving formation may be a channel-shaped cavity defined by laterally spaced sidewalls, an end wall and a bottom wall, formed in the elongate body, in which cavity the trigger guard is slidingly receivable.

The automatically releasing retaining means may include a catch which is biassed into a normal rest condition in which it projects into the cavity, the catch, when the trigger guard is received in the cavity, being automatically displaceable against the bias by cam action through sliding contact with the trigger guard from its normal rest condition to a tensed condition in which it is out of the cavity and allows the trigger guard to be seated in the cavity, the catch then automatically returning under bias to its normal rest condition in which it projects into the cavity and remains in contact with the trigger guard to retain the firearm in position in the device; and the catch, when the firearm is withdrawn from the device, being automatically displaceable against the bias by cam action through sliding contact with the trigger guard from its normal rest condition and to a tensed condition in which it is out of the cavity to release the firearm.

The catch may be provided on a resiliently deformable lever secured to the elongate body and the catch projects into the cavity through an opening in a sidewall of the cavity, such that the automatically releasing retaining means is in the form of a resiliently deformable pawl. The catch may thus slidably contact the trigger guard so that contact of the catch with the trigger guard during positioning of a firearm in the holding device, or withdrawal of a firearm from the holding device, resiliently displaces the catch from the normal rest condition of the pawl to its tensed condition.

The firearm, particularly when it is a handgun, may thus be movable between a holstered position in which the trigger guard is received within the cavity and retained in position by the catch, and an unholstered position in which the trigger guard is withdrawn from the cavity, movement from the holstered position to the unholstered position being by withdrawing the handgun from the device, causing the trigger guard to bear against and slide over the catch, thereby to displace the catch against the spring bias of the resiliently deformable pawl.

The firearm holding device may include locking means for locking the catch in its normal rest condition thereby preventing withdrawal of the firearm from the device.

The locking means may be a locking lever pivotally mounted on the elongate body and pivotable between a released condition in which it permits displacement of the catch, and a locked condition in which it resists displacement of the catch from its normal rest condition. The locking lever may be spring-loaded so that the lever is urged into the locked condition and has manually to be released in order to allow withdrawal of the handgun.

The firearm holding device may include adjustment means for adjusting the width of the channel such that the device is adjustable to hold firearms having trigger guards of different widths.

The side walls of the cavity may be resiliently flexible and the adjustment means include a screw mounted on the elongate body and extending transversely across the cavity, so that rotation of the screw in one direction draws the side walls of the cavity together causing narrowing of the cavity, and rotation of the screw in the opposite direction forces the side walls of the cavity apart causing widening of the cavity. The width of the cavity may also be adjusted such that the trigger guard will fit with some inteference, or snugly, in the cavity, which will assist in retaining the trigger guard in the cavity.

The adjustment means may include at least one spacer plate, or shim, securable to an inner surface of a side wall of the cavity.

The connecting means may be a hip plate having a loop through which a belt of a wearer of the device can be passed in use, for connecting the principal support member to the person of the wearer.

The firearm holding device may include rake adjustment means operable to adjust the rake angle of the principal support member. Both the connecting means and the rake adjustment means may be removable.

The rake adjustment means may include a pivotal link interconnecting the principal support member and the hip plate, about which the principal support member is pivotable with respect to the hip plate.

The holding device may include rake locking means for locking the rake of the principal support member in a desired orientation.

The holding device may, further, be provided with vertical adjustment means operable to allow adjustment of the position of attachment of the support member to the hip plate so that the holding device is adjustable in an operatively vertical direction with respect to the belt. The hip plate may, furthers be provided with a backing layer of a hook and eye material such as Velcro (Trade Mark), for engagement with a similar layer on a wearer's trousers. The hip plate may, still further, be provided with a lip for engagement with the belt to provide stability to the holster.

The firearm holding device may be a moulding of synthetic plastics material, e.g. a thermoplastic material. It may, instead, be a composite body, parts of which are of a synthetic polymeric or plastics material and other parts of which are of a metal such as aluminium. For example, the secondary support member and the receiving formation may be of a synthetic plastics material and the remainder of the elongate body may be of aluminium.

It will be appreciated that the firearm holding device of the invention is intended primarily, but not exclusively, as a speed holster for handguns, in which the likelihood that a handgun will become dislodged and fall out of the holster when a wearer of the holster is engaged in activities such as running, climbing, jumping and the like is prevented or reduced; and, simultaneously, the handgun is readily accessible to the wearer and easily withdrawn from the holster by the wearer, due to operation of the automatically releasing retaining means. Such situations would arise, for example, during practical handgun shooting activities and combat. The firearm holding device of the invention can, however, also be used as a security or safety aid to secure a handgun on the wearer's person so as to prevent, for example, a person who wishes to snatch the handgun from withdrawing the handgun from the holster.

The invention will now be described by way of example with reference to the accompanying diagrammatic drawings, in which.

Figure 10A:
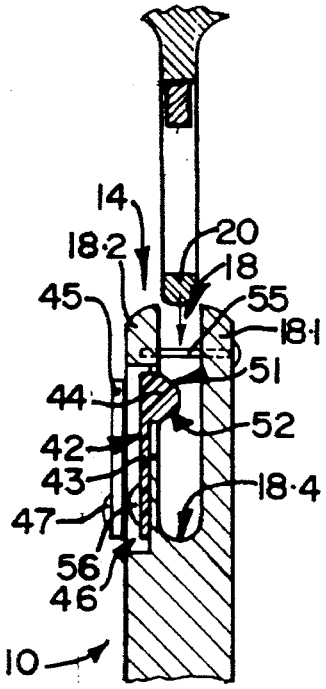
FIG. 10A shows a fragmentary sectional end view of a channel-shaped cavity and pawl of a firearm holding device in accordance with the invention in use, with a trigger guard of a firearm about to enter the cavity.
Figure 10B:
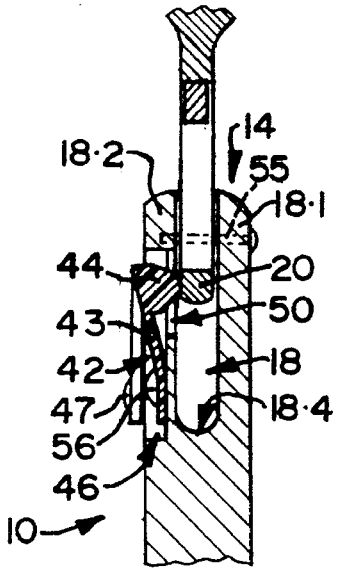
FIG. 10B shows a fragmentary sectional end view of a channel-shaped cavity and pawl of a firearm holding device in accordance with the invention in use, with a trigger guard of the firearm in sliding contact with the catch, and the catch in its tensed condition out of the cavity.
Figure 10C:
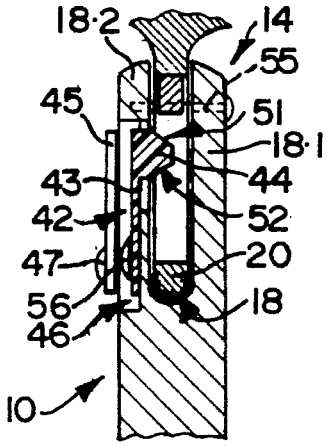
Figure 11:
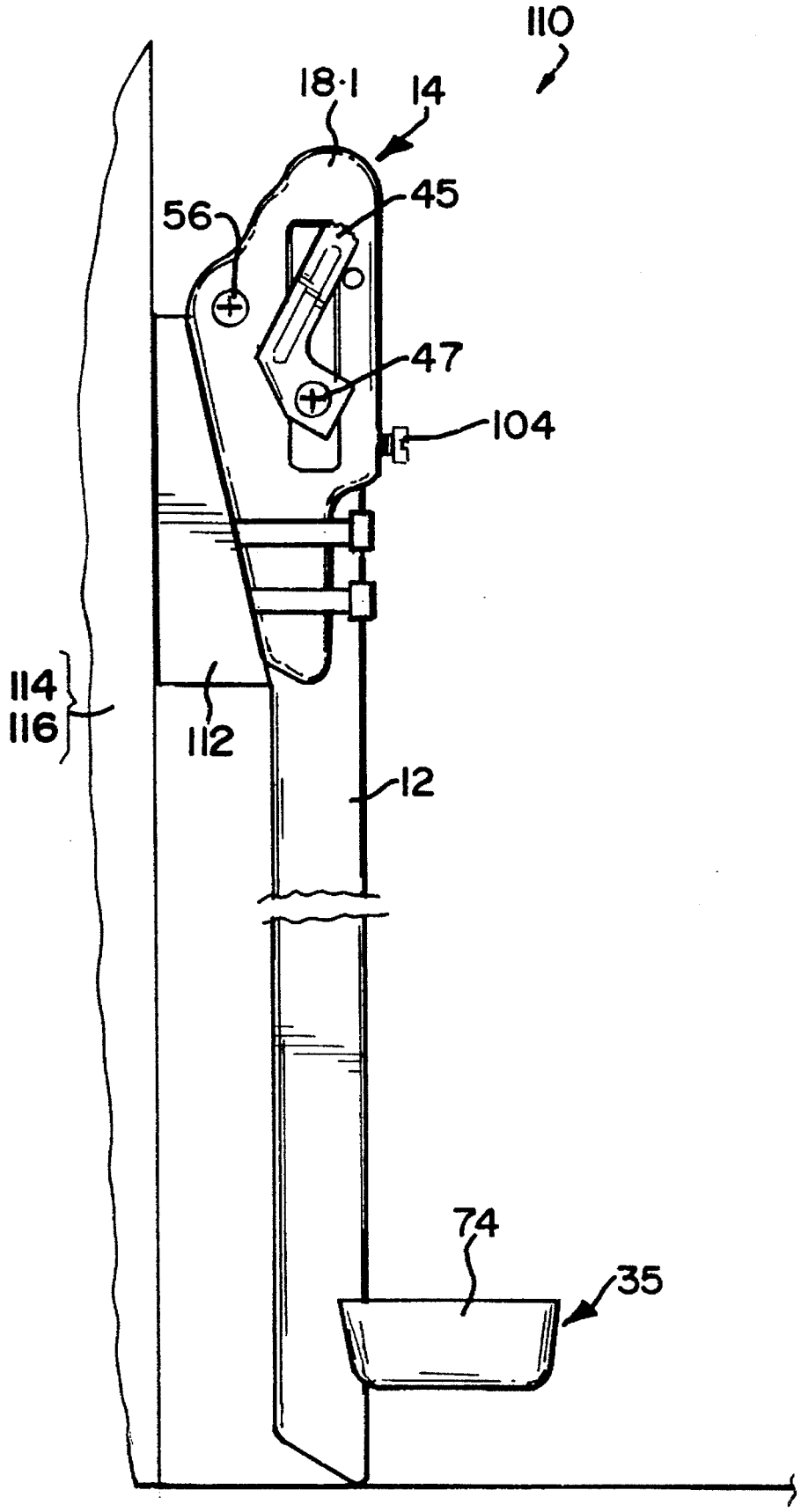

FIG. 10C shows a fragmentary sectional end view of a channel-shaped cavity and pawl of a firearm holding device in accordance with the invention in use, with a trigger guard seated in the cavity and the catch in its normal rest condition in the cavity and in contact with the trigger guard to retain the firearm in position in the device; and FIG. 11 shows a fragmentary side view of yet another embodiment of a firearm holding device according to the invention.

Referring to the drawings, reference numeral 10 generally indicates a firearm holding device in accordance with the invention, in the form of a speed holster for a handgun.

Figure 1:
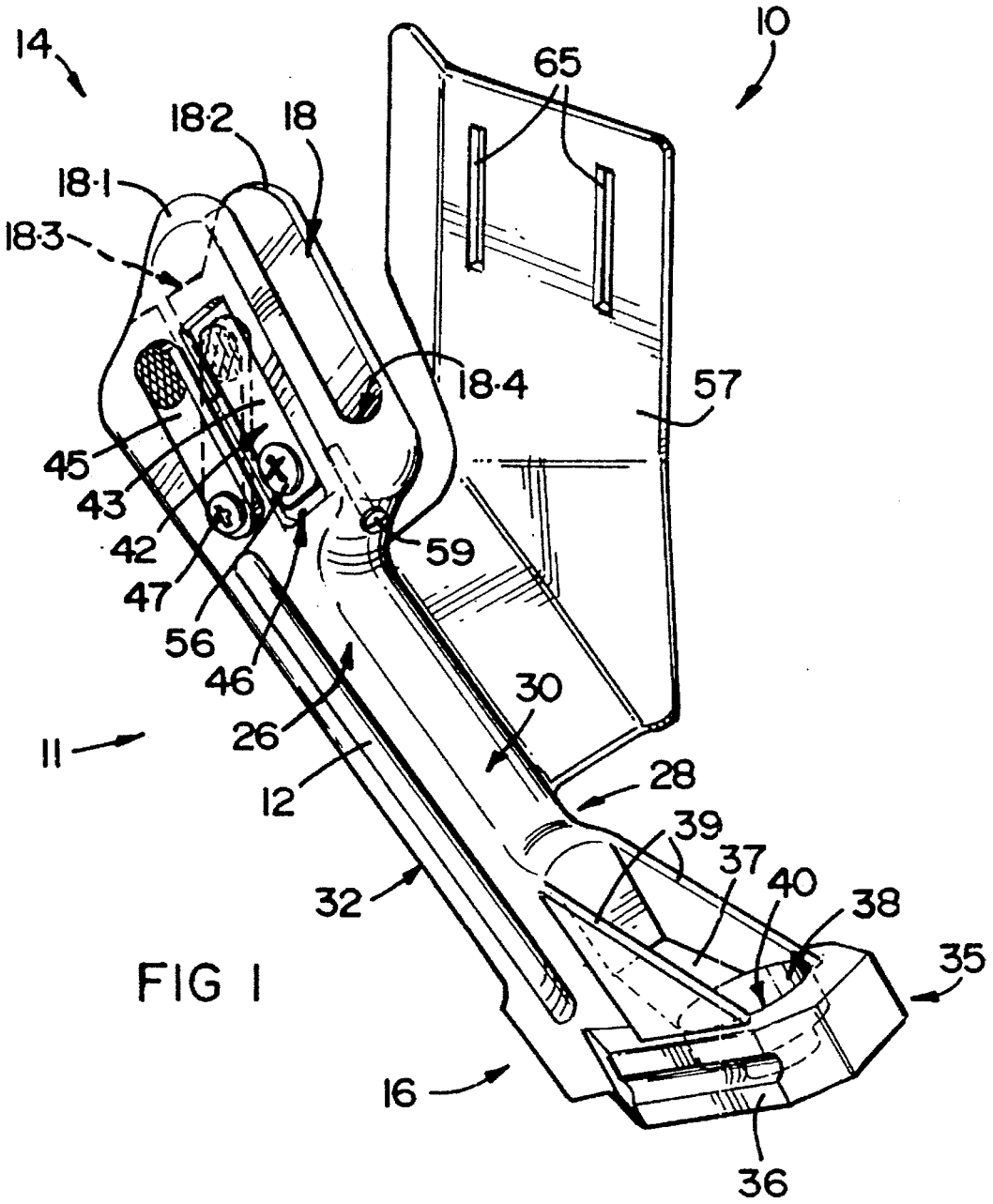
FIG. 1 shows a three-dimensional view of an embodiment of a firearm holding device in accordance with the invention.

The holster 10 includes a principal support member 11 which comprises an elongate bar-like body 12 having an upper end 14 and a lower end 16. The upper end 14 is bifurcated and defines a receiving formation in the form of a downwardly extending channel-shaped cavity 18 defined by laterally spaced sidewalls 18.1 and 18.2, an end wall 18.3 and a bottom wall 18.4 for releasably receiving a portion of a trigger guard 20 of a handgun 22 as is described in further detail below. The body 12 has outer and inner sides 26, 28 respectively, a leading side 30 and a trailing side 32. The body 12 is of approximately uniform thickness, i.e. the distance between the outer and inner sides 26, 28 is approximately uniform over the length of the body. The upper end 14 is broader from the leading side to the trailing side than the remainder of the body 12 as can be seen in FIG. 1. The body is integrally formed of a thermoplastics material, and the sidewalls 18.1 and 18.2 of the cavity 18 are resiliently flexible. In other embodiments of the invention (not shown), the upper and lower ends 14, 16 are detachable from the body 12.

A secondary support member is in the form of a support bracket generally designated by reference numeral 35, and which comprises a projection 36 which projects forwardly i.e. away from the leading side 30 of the lower end 16 of the body 12. A stepped socket 38 defining an upwardly directed shoulder 40 extends through the projection 36 and acts as a support for receiving the muzzle end, or a compensator, of the handgun 22 as is described in further detail below. An upwardly sloping portion 37 of the front face 30 leads up to the socket 38 and acts, in use, as a guide for the muzzle 23 of the handgun 22. Two triangular-shaped guide walls or gussets 39 connect the projection 36 with the leading side 30 of the lower end 16 and also act, in use, as guides for the muzzle end of the handgun.

In other embodiments of the invention (not shown), the projection 36 is provided with an upwardly projecting spigot which is receivable in the muzzle 23 of the handgun 22. In yet another embodiment of the invention described below the bracket 35 is detachable and is provided with an adjustment mechanism for adjusting the distance between the projection 36 and the end 14 so that handguns of different lengths can be held in the holster 10. The spigot may, in another embodiment of the invention, be detachable and replaceable so that spigots of different diameters can be used to accommodate handguns having different sized barrels i.e. handguns of different calibers.

Automatically releasing retaining means in the form of a resiliently deformable pawl 42 comprising a resiliently deformable lever 43 having a catch 44 at one end, is provided in a recess 46 in the outer side 26 of the broader upper end 14 of the body 12. The catch 44 projects inwardly into the cavity 18 through an opening 50 in the outer side 26 of the body 12. In the normal rest condition of the pawl 42 shown in FIGS. 1, 2, 3, 6, 9, 10A and 10C, the catch 44 projects into the cavity 18. The catch 44 has sloping sides 51, 52 as can be seen in FIGS. 4, 6, 10A and 10C, for engagement with the trigger guard 20. The pawl 42 is secured in the recess 46 to the body 12 by a screw 56 and is of a resiliently deformable material such as high density polyethylene so that it can be resiliently or elastically displaced outwardly, i.e. away from the body 12, to a tensed condition shown in FIG. 10B in which the catch 44 is out of the cavity 18 and the trigger guard 20 is allowed to be seated in, or released from, the cavity 18.

Figure 2:
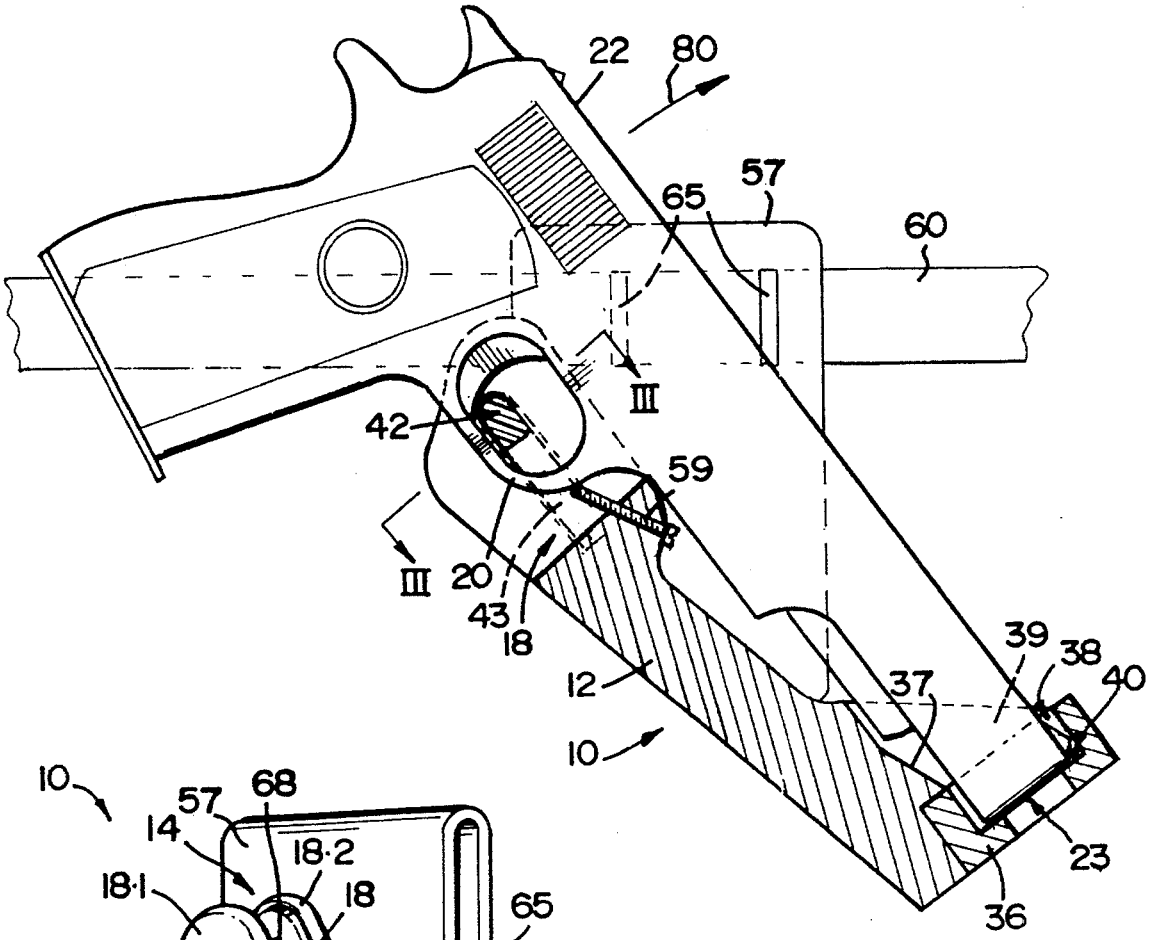
FIG. 2 shows a sectional side view of the device of FIG. 1 in use.

Adjustment means in the form of a screw 55 which passes transversely through the cavity 18 is provided, for adjusting the width of the cavity 18. Tightening of the screw 55 results in a narrowing of the cavity 18 and loosening the screw 55 results in widening of the cavity, such that the holster 10 is adjustable to hold handguns having trigger guards of different widths. A further adjustment screw 59 extends into the cavity 18 and, in use, abuts against the trigger guard 20 as can be seen in FIG. 2. The adjustment screw 59 acts as an adjustable trigger guard stop for seating the trigger guard in the cavity 18. Locking means in the form of a pivotally mounted safety lever 45 is pivotally mounted on the body 12 by means of a screw 47 and is pivotable into a locked condition, shown in dotted outline in FIG. 1, to prevent outward resilient deformation of the pawl 42 thereby locking the pawl 42 in its normal rest condition to prevent withdrawal of the handgun 22 from the holster 10.

Figure 3:
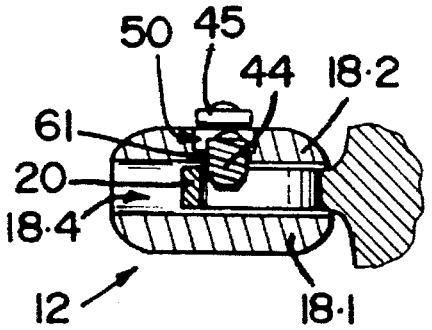
FIG. 3 shows a sectional view through III—III of FIG. 2.

Referring to FIG. 3, the lower side 61 of the catch 44 is flat and abuts against the trigger guard 29 when the handgun 22 is held in the holster 10. This serves to prevent the handgun 22 from being displaced in the direction of the arrow 80 (FIG. 2) when it is in the holster 10 and serves to further secure the handgun 22 in the holster 10.

Connecting means in the form of contoured hip plate 57 having loops 65 for connecting the holster 10 to a belt 60 of a wearer, is secured by screws (not shown) to the inner side 28 of the body 12. The plate 57 is contoured to fit against the hip of the wearer and is optionally provided with a lip (not shown) for engagement with the belt of the user to impart stability to the holster 10. The plate 57 is further optionally provided with a layer of hook and eye material (not shown) such as Velcro (Trade Mark) for engagement with a similar layer on the wearer's trousers and/or belt.

In another embodiment of the invention, the holster 10 is manufactured in a manner such that the pawl 42 and the hip plate 57 are mounted on sides of the body 12 opposite to those depicted in the Figures, for left-handed carry of a firearm.

In FIGS. 4 to 11 of the drawings, like numerals denote the same or similar features to those indicated in FIGS. 1 to 3 of the drawings.

Figure 4:
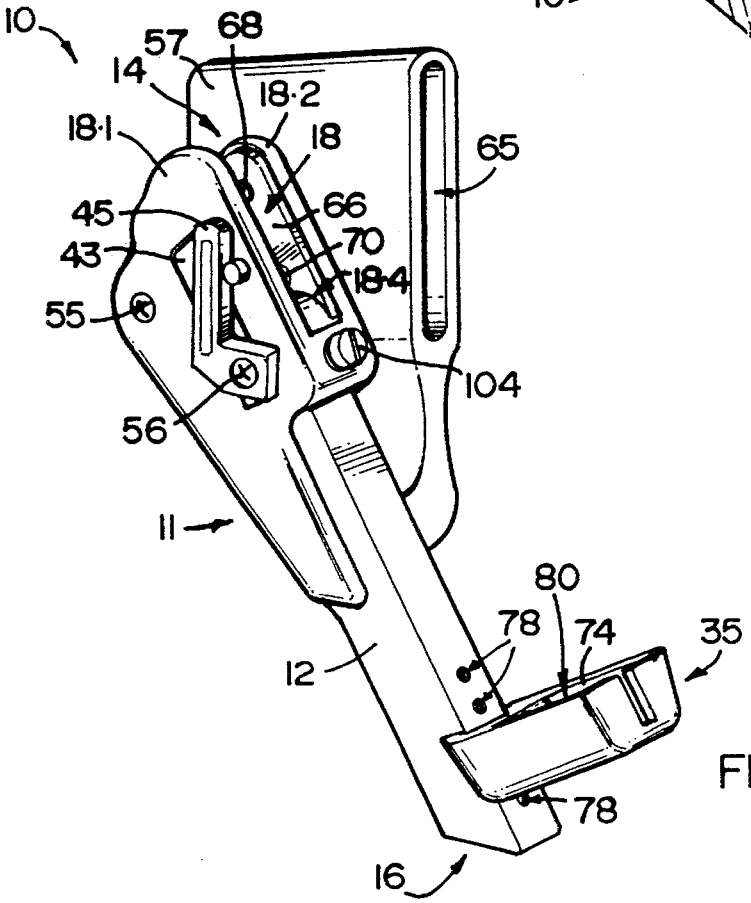
FIG. 4 shows a three-dimensional view of another embodiment of a firearm holding device in accordance with the invention.
Figure 5:
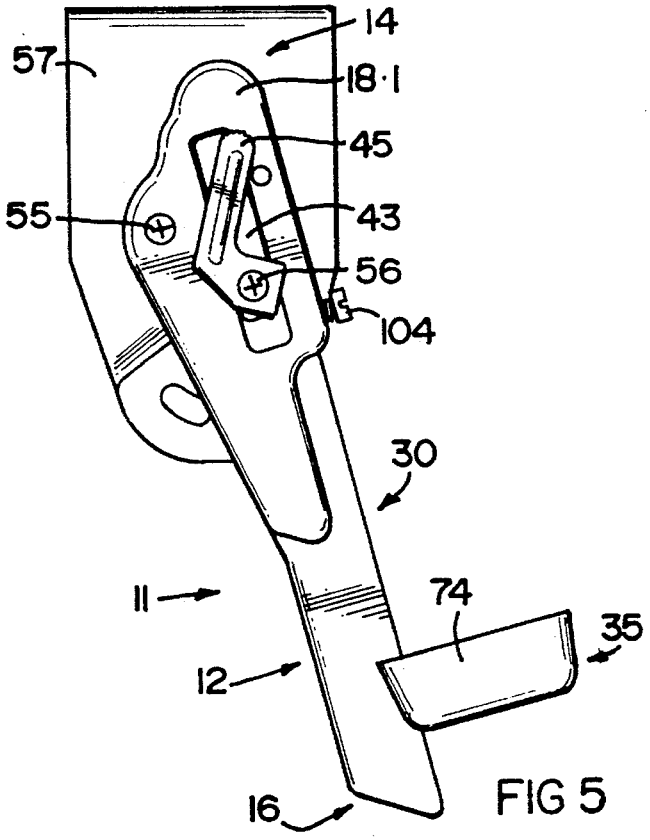
FIG. 5 shows a side view from one side of the device of FIG. 4.
Figure 6:
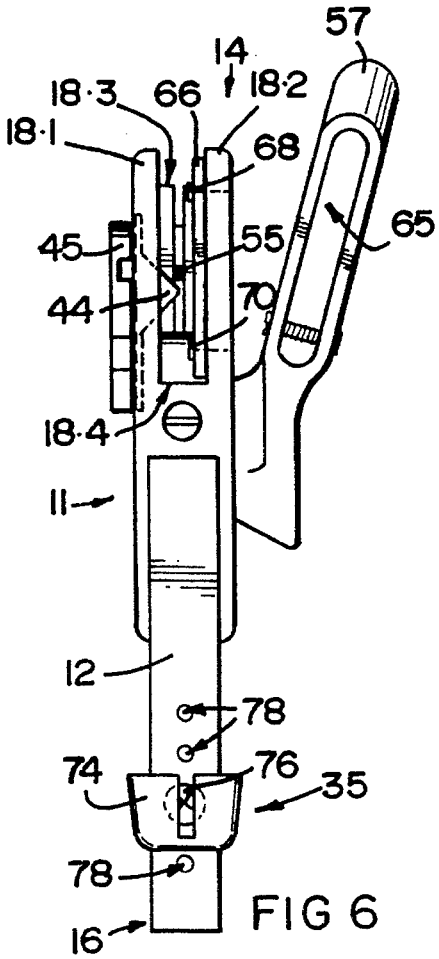
FIG. 6 shows a front end view of the device of FIG. 4.
Figure 7:
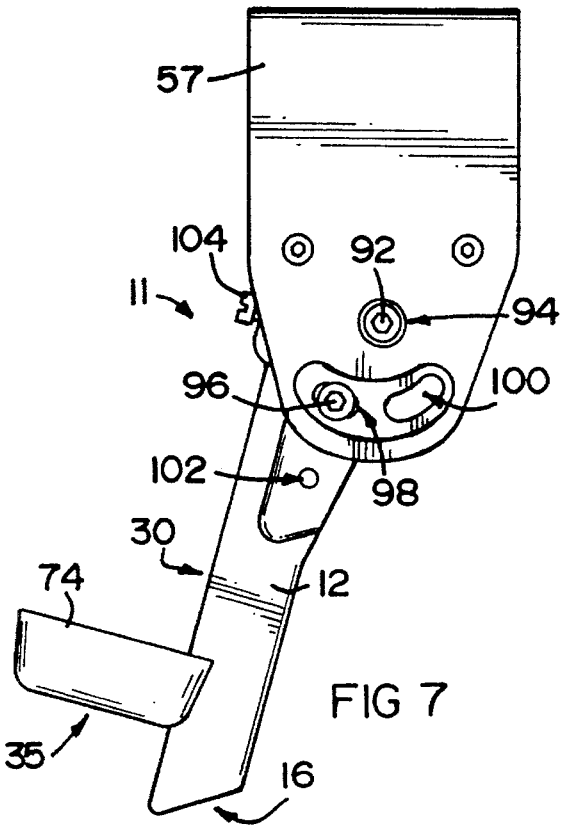
FIG. 7 shows a side view from another side of the device of FIG. 4.
Figure 8:
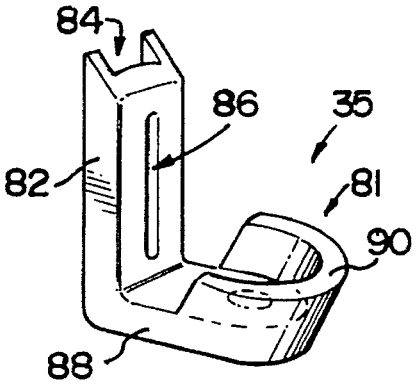
FIG. 8 shows a three-dimensional view of another embodiment of a support bracket of a firearm holding device according to the invention.
Figure 9:
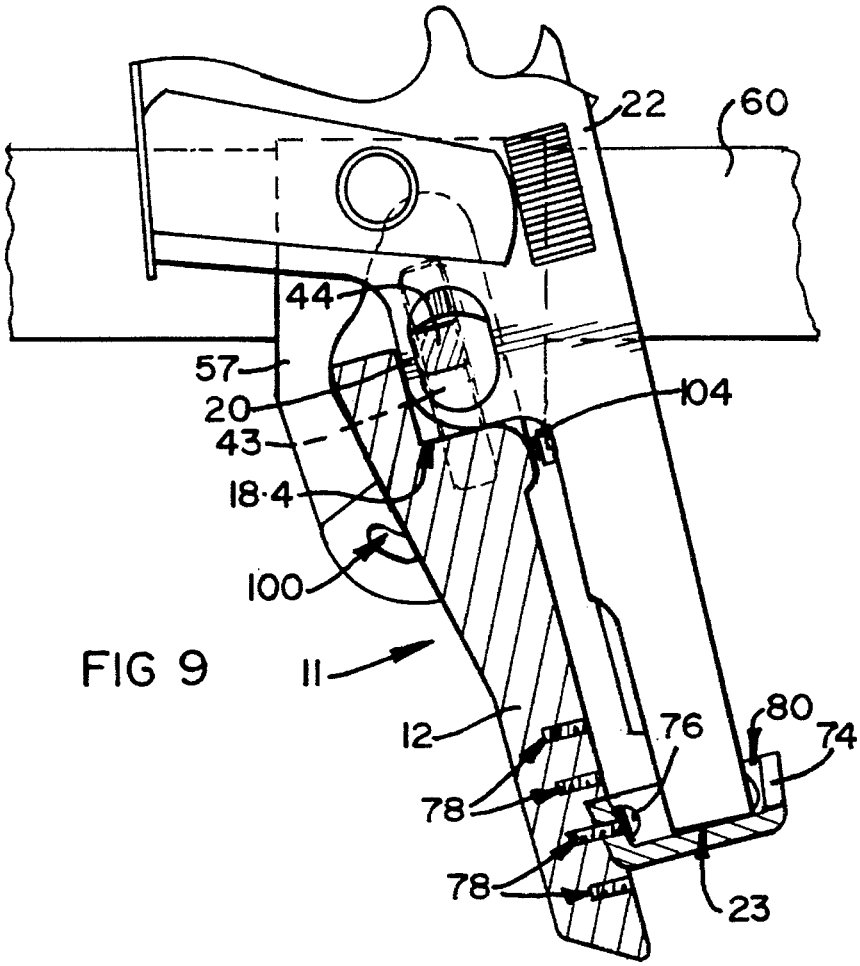
FIG. 9 shows a sectional side view of the device of FIG. 4 in use.

Referring to FIGS. 4 and 6 of the drawings, the adjustment means for adjusting the width of the cavity 18 includes a spacer plate or shim 66 secured by means of screws 68 and 70 to the inside surface of side wall 18.2.

In one embodiment, the support bracket 35 is in the form of a trough-shaped member 74 which is securable at graduated locations along the length of the body 12 by means of a screw 76 passing through an opening (not shown) in the member 74 and co-operating with screw-threaded bores 78 which are at graduated intervals along the length of the body 12.

The trough-shaped member 74 defines a socket or recess 80 into which the muzzle end of the handgun 22 fits. The trough-shaped member is suitable for receiving the muzzle ends of handguns or other firearms which are of relatively small calibre and/or slender construction. In another embodiment shown in FIG. 8, the support bracket 35 is in the form of a substantially "L"-shaped member 81, with the upright limb of the "L" 82 being provided with a groove 84 which fits over the body 12, and an elongate slot 86 through which the screw 76 passes to co-operate with the screw threaded bores 78 and secure the bracket 35 to the body 12, such that the location of the bracket 35 on the body 12 is adjustable along the length of the body 12. The horizontal limb of the "L", or projection, 88 has an arcuate lip 90 for retaining the muzzle end of a handgun 22 on the projection 88. The "L"-shaped member 81 is suitable for receiving the muzzle ends of handguns or other firearms which are of relatively large calibre and/or thick construction.

Rake adjustment means in the form of a pivotal link or screw 92 is provided, passing through a hole in the hip plate 57 and into a bore (not shown) in the body 12, and interconnecting the body 12 and the hip plate 57. The body 12 is pivotable about the pivotal screw 92 with respect to the hip plate 57, and lockable in a desired position by means of lock screw 96 passing through one of arcuate apertures 98 and 100 in the hip plate 57 and into a bore (not shown) in the body 12, thereby to lock the rake of the principal support member 11 in a desired orientation. A further bore 102 is provided in the body 12 into which the pivotal screw 92 can be received, to serve as a vertical adjustment means operable to allow adjustment of the position of attachment of the hip plate 57 to the principal support member 11, so that the holster 10 is adjustable in an operatively vertical direction with respect to the belt 60 of a wearer. A seating screw 104 is received in a bore (not shown) in the front side 30 of the body 12. The seating screw 30 is adjustable to abut against the frame of the handgun 22, or other firearm, when it is positioned in the holster 10, to reduce the rocking of the firearm 22 while it is held in the device 10.

In use, the holster 10 is attached to the belt 60 of the wearer by passing the belt 60 through the loops 65 in the hip plate 57, and securing the belt 60 around the wearer's waist. Insertion of the handgun 22 into the holster 10 then involves insertion of the trigger guard 20 into the cavity 18 (FIG. 10A) so that the muzzle 23 of the handgun 22 abuts against the shoulder 40 of the socket 38, or is received in the socket 80 of the trough-shaped member 74, or within the lip 90 of the "L"-shaped member 81. As the trigger guard 20 is pushed downwardly into the cavity 18 it engages with the catch 44 and displaces the pawl 42 outwardly by cam action to its tensed condition (FIG. 10B). After the trigger guard 20 has slid over the catch 44, the pawl 42 snaps back into position thereby retaining the handgun 22 in position in the holster 10, as shown in FIG. 10C. Withdrawal of the handgun 22 from the holster 10 causes the trigger guard 20 again to slide over the catch 44 and to displace the pawl 42 outwardly automatically by cam action to its tensed condition in which the catch 44 is withdrawn from the channel 18, so that the handgun 22 is automatically released from the holster 10 when it is withdrawn from the holster 10.

The Applicants believe that the holster 10 of the invention will allow a handgun such as a pistol or a revolver to be held relatively securely in a readily accessible position and will allow rapid drawing and firing of the handgun by a wearer of the holster 10. The pawl 42 will serve to prevent, or at least limit, the likelihood that the handgun 22 will be jarred loose from the holster 10 when the wearer of the holster 10 is engaged in activity such as running, jumping, climbing and the like. The Applicants further believe that the pawl 42 should not substantially inhibit the speed with which the handgun 22 may be withdrawn from the holster 10 and should allow more rapid withdrawal than is the case with prior art holsters which are provided with locking means which are continuously operative and have independently to be unlocked through the intervention of the wearer in order to release the handgun from the holster each time the handgun is to be withdrawn from the holster.

The Applicants further believe that it is an advantage of a holster 10 according to the invention that, due to the elongate body 12 leaving the firearm 22 exposed with the exception of the trigger guard 20 when it is held in the holster 10, the holster 10 is versatile and can accommodate handguns fitted with various accessories. The accessories can include, for example, frame-mounted electronic optical sights mounted either in the traditional top slide position or at the sides of the slide of the handgun; laser sights mounted either in the traditional underbarrel or trigger guard position (in which case a suitable cutout in the body 12 of the holster 10 can be provided to accommodate the laser sight) or on the sides or top of the slide; integral or removable balancing weights connectable to the frame of the handgun 22 to balance it for competition purposes; integral or removable slide guards used in barricade-type events such as the Bianchi Event and similar type of shoots; compensating devices of different widths, heights and/or overall lengths which may be of one or more of a barrel-mounted, slide-mounted or frame-mounted type. A further advantage of the elongate and slender construction of the body 12 is that it renders the holster 10 relatively unobtrusive and convenient to use, particularly in combat situations where the wearer may need to be in a prone position.

It is a further advantage of the holster 10 that, in one embodiment, dimensions such as the distance between the secondary support 35 and the cavity 18, as well as the width of the cavity 18, can be adjusted. Similarly, the dimensions of the spigot or the socket of the secondary support member can be changed by either replacing the secondary support, or by replacing the spigot of the secondary support. This allows the holster 10 to be used for different firearms of different sizes so that a person need not necessarily need to have a variety of different holsters if he owns a variety of different firearms. It is also an advantage of the holster 10 that it can be manufactured in a manner such that the catch 42 and the plate 57 can be mounted on either side of the body 12 so that the holster 10 can be used by a right-handed or a left-handed person. It is a further advantage of that the holster 10 can optionally be manufactured in modular form e.g. in three parts namely the receiving formation and automatically releasing retaining means, the secondary support and the remainder of the elongate body.

It will be appreciated that, as shown in FIG. 11 of the drawings, in an extended or enlarged form the firearm holding device according to the invention is in the form of a rifle rack 110 to hold rifles, shotguns, hunting handguns or crossbows on moving vehicles during hunting trips, and has connecting means in the form of a connecting bracket 112 instead of a hip plate 57 to connect it to a support means in the form of a wall 114 of a vehicle body. Similarly, in the enlarged rifle rack version the firearm holding device according to the invention can be installed on a wall 116 in a safe or storage room, or in a dwelling to hold the above-mentioned weapons, particularly in the case of collector's items, or where they are dangerous or easily removable weapons.

We claim:

1. A firearm holding device which includes a principal support member comprising an elongate body having two ends and provided with a receiving formation at one end thereof for releasably receiving at least a portion of a trigger guard of the firearm, the body leaving the remainder of the firearm exposed;

automatically releasing retaining means on the principal support member, the retaining means operating to retain the firearm in the device when the firearm is positioned in the device, and automatically to release the firearm when it is withdrawn from the device;

a secondary support member spaced from the receiving formation, for supporting a portion of the firearm which is spaced forwardly of the trigger guard when the firearm is positioned in the device;

said secondary support member being a support bracket securable to the elongate body at graduated locations along the length of the elongate body, and on which the muzzle end of the firearm is supported in use; and, connecting means secured to the principal support member, for connecting the principal support member to support means for the device.

2. A firearm holding device as claimed in claim 1 wherein the receiving formation is a channel-shaped cavity defined by laterally spaced sidewalls, an end wall and a bottom wall, formed in the elongate body, in which cavity the trigger guard is slidingly receivable.

3. A firearm holding device as claimed in claim 2 wherein the automatically releasing retaining means includes a catch which is biassed into a normal rest condition in which it projects into the cavity, the catch, when the trigger guard is received in the cavity, being automatically displaceable against the bias by cam action through sliding contact with the trigger guard from its normal rest condition to a tensed condition in which it is out of the cavity and allows the trigger guard to be seated in the cavity, the catch then automatically returning under bias to its normal rest condition in which it projects into the cavity and remains in contact with the trigger guard to retain the firearm in position in the device; and the catch, when the firearm is withdrawn from the device, being automatically displaceable against the bias by cam action through sliding contact with the trigger guard from its normal rest condition and to a tensed condition in which it is out of the cavity to release the firearm.

4. A firearm holding device as claimed in claim 3 wherein the catch is provided on a resiliently deformable lever secured to the elongate body and the catch projects into the cavity through an opening in a sidewall of the cavity, such that the automatically releasing retaining means is in the form of a resiliently deformable pawl.

5. A firearm holding device as claimed in claim 3 or claim 4 which includes locking means for locking the catch in its normal rest condition thereby preventing withdrawal of the firearm from the device.

6. The firearm holding device as claimed in claim 5 wherein the locking means is a locking lever pivotally mounted on the elongate body and pivotable between a released condition in which it permits displacement of the catch, and a locked condition in which it resists displacement of the catch from its normal rest condition.

7. A firearm holding device as claimed in claim 2, which includes adjustment means for adjusting the width of the channel such that the device is adjustable to hold firearms having trigger guards of different widths.

8. A firearm holding device as claimed in claim 7 wherein the side walls of the cavity are resiliently flexible and the adjustment means includes a screw mounted on the elongate body and extending transversely across the cavity so that rotation of the screw in one direction draws the side walls of the cavity together causing narrowing of the cavity, and rotation of the screw in the opposite direction forces the side walls of the cavity apart causing widening of the cavity.

9. A firearm holding device as claimed in claim 7 or claim

8 wherein the adjustment means includes at least one spacer plate securable to an inner surface of a side wall of the cavity.

10. A firearm holding device as claimed in claim 1 wherein the connecting means is a hip plate having a loop through which a belt of a wearer of the device can be passed in use, for connecting the principal support member to the person of the wearer.

11. A firearm holding device as claimed in claim 10, which includes rake angle adjustment means operable to adjust the rake angle of the principal support member.

12. A firearm holding device as claimed in claim 11 wherein the rake angle adjustment means includes a pivotal link interconnecting the principal support member and the hip plate, about which the principal support member is pivotable with respect to the hip plate.

13. A firearm holding device as claimed in claim 11 or claim 12 which includes rake locking means for locking the rake angle of the principal support member in a desired orientation.

14. A firearm holding device as claimed in claim 1 which includes vertical adjustment means operable to allow adjustment of the position of attachment of the connecting means to the principal support member, so that the holding device is adjustable in an operatively vertical direction.

15. A firearm holding device as claimed in claim 1, which is a moulding of synthetic plastics material.

* * * * *